US009958214B2

(12) United States Patent
Dupont

(10) Patent No.: US 9,958,214 B2
(45) Date of Patent: May 1, 2018

(54) CAPILLARY-PUMPING HEAT-TRANSPORT DEVICE

(75) Inventor: Vincent Dupont, Etterbeek (BE)

(73) Assignee: EURO HEAT PIPES, Nivelles (BE)

( * ) Notice: Subject to any disclaimer, the term of this patent is extended or adjusted under 35 U.S.C. 154(b) by 1041 days.

(21) Appl. No.: 14/344,880

(22) PCT Filed: Sep. 12, 2012

(86) PCT No.: PCT/EP2012/067752

§ 371 (c)(1),
(2), (4) Date: Oct. 31, 2014

(87) PCT Pub. No.: WO2013/037784

PCT Pub. Date: Mar. 21, 2013

(65) Prior Publication Data

US 2015/0083373 A1 Mar. 26, 2015

(30) Foreign Application Priority Data

Sep. 14, 2011 (FR) ..... 11 58202

(51) Int. Cl.
*F28D 15/00* (2006.01)
*F28D 15/04* (2006.01)

(52) U.S. Cl.
CPC ..... *F28D 15/046* (2013.01); *F28D 15/043* (2013.01)

(58) Field of Classification Search
CPC ..... F28D 15/046; F28D 15/043; F28D 15/04
USPC ..... 165/104.26
See application file for complete search history.

(56) References Cited

U.S. PATENT DOCUMENTS 2,366,955 A 1/1945 Burggrabe
3,613,778 A * 10/1971 Feldman, Jr. ..... B64G 1/506 165/104.26
4,061,131 A * 12/1977 Bohanon ..... F24J 2/4649 126/590
4,286,579 A 9/1981 Johnston
4,296,729 A * 10/1981 Cooper ..... F24D 17/0021 126/584
4,792,283 A 12/1988 Okayasu
4,830,097 A 5/1989 Tanzer
4,957,157 A * 9/1990 Dowdy ..... B64G 1/50 165/104.26
4,986,348 A 1/1991 Okayasu
(Continued)

FOREIGN PATENT DOCUMENTS

FR 2602851 A1 2/1988
FR 2 949 642 A1 3/2011
(Continued)

*Primary Examiner* — Len Tran
*Assistant Examiner* — Claire Rojohn, III
(74) *Attorney, Agent, or Firm* — Seed IP Law Group LLP

(57) ABSTRACT

A capillary-driven heat transfer device, adapted to extract heat from a heat source and to release this heat to a cold source by means of a two-phase working fluid, includes an evaporator, having a microporous mass adapted to perform capillary pumping of fluid in the liquid phase, a condenser, a reservoir having an inlet and/or outlet port, a vapor communication circuit, connecting the outlet of the evaporator to the inlet of the condenser, and a liquid communication circuit connecting the outlet of the condenser to the reservoir and to the inlet of the evaporator. The reservoir includes multiple separate volumes that remain in fluid communication.

14 Claims, 3 Drawing Sheets

(56) References Cited

U.S. PATENT DOCUMENTS 5,203,399 A 4/1993 Koizumi
5,259,447 A * 11/1993 Ogushi ..... B64G 1/50 165/104.22
5,816,313 A 10/1998 Baker
5,881,801 A 3/1999 Hayakawa et al.
5,944,092 A * 8/1999 Van Oost ..... F28D 15/043 165/104.24
6,058,711 A * 5/2000 Maciaszek ..... F28D 15/043 165/104.26
6,227,288 B1 * 5/2001 Gluck ..... F28D 15/043 165/104.26
6,840,304 B1 * 1/2005 Kobayashi ..... B01D 3/007 165/104.25
6,865,897 B2 * 3/2005 Jibb ..... F25B 23/006 165/104.26
6,883,588 B1 * 4/2005 Low ..... B64G 1/50 126/613
6,990,816 B1 * 1/2006 Zuo ..... B64G 1/50 62/3.7
7,061,446 B1 * 6/2006 Short, Jr. ..... H01Q 1/02 165/139
7,549,461 B2 6/2009 Kroliczek et al.
7,748,436 B1 * 7/2010 Anderson ..... F28D 15/046 165/104.21
7,823,629 B2 * 11/2010 Rosenfeld ..... F28D 15/043 165/104.26
7,980,294 B2 7/2011 Ohashi
8,047,268 B1 11/2011 Kroliczek et al.
8,136,580 B2 3/2012 Kroliczek et al.
8,627,847 B2 1/2014 Montague
9,504,185 B2 * 11/2016 Xiang ..... H01L 23/427
9,696,096 B2 * 7/2017 Uchida ..... F28D 15/0266
2003/0066625 A1 * 4/2003 Kirshberg ..... B82Y 30/00 165/80.3
2003/0145622 A1 * 8/2003 Kawasaki ..... B64G 1/50 62/503
2005/0067146 A1 3/2005 Thayer et al.
2006/0065386 A1 3/2006 Alam
2006/0137853 A1 * 6/2006 Haller ..... B60H 1/005 165/42
2007/0062675 A1 * 3/2007 Chen ..... H01L 23/473 165/104.27
2007/0163756 A1 * 7/2007 Wang ..... H05K 7/20336 165/104.26
2008/0078530 A1 * 4/2008 Chang ..... F28D 15/043 165/104.26
2008/0225489 A1 * 9/2008 Cai ..... F28D 15/0266 361/704
2008/0283223 A1 * 11/2008 Chang ..... F28D 15/043 165/104.26
2010/0101762 A1 4/2010 Kroliczek et al.
2010/0259888 A1 * 10/2010 Pomytkin ..... G06F 1/20 361/679.47
2010/0300656 A1 * 12/2010 Lu ..... F28D 15/0266 165/104.26
2011/0192575 A1 8/2011 Figus
2012/0291989 A1 11/2012 Fong et al.
2015/0114605 A1 * 4/2015 Dupont ..... F28D 15/06 165/104.26

FOREIGN PATENT DOCUMENTS

GB 1 402 509 8/1975
JP 61-175483 A 8/1986

* cited by examiner

CAPILLARY-PUMPING HEAT-TRANSPORT DEVICE

The present invention relates to capillary-driven heat transfer devices, in particular two-phase fluid loop passive devices.

It is known from document FR-A-2949642 that such devices are used as a means to cool electrotechnical power converters.

However, it has appeared that the startup phases were especially subject to problems in the presence of high thermal power levels, drying-out of the capillary wick may occur resulting in startup failure.

Furthermore, if the device is submitted to acceleration, a cold shock phenomenon may occur in the reservoir which suddenly lowers the pressure and deteriorates performance.

There therefore appeared a need to increase the reliability of the startup and operation of such loops.

To this end, the invention relates to a capillary-driven heat transfer device, adapted to extract heat from a heat source and to release this heat to a cold source by means of a two-phase working fluid contained in a closed general circuit, comprising:

- at least one evaporator, having an inlet and an outlet, and a microporous mass adapted to perform capillary pumping of fluid in the liquid phase
- at least one condenser, having an inlet and an outlet,
- a reservoir having an inner chamber and at least one inlet and/or outlet port, with a vapor phase portion located on top of a liquid phase portion,
- a first communication circuit, for fluid mainly in the vapor phase, connecting the outlet of the evaporator to the inlet of the condenser,
- a second communication circuit, for fluid mainly in the liquid phase, connecting the outlet of the condenser to the reservoir and to the inlet of the evaporator, characterized in that the reservoir includes multiple separate volumes of the liquid phase, said separate volumes remaining in fluid communication, the reservoir comprising a plurality of inner partitions forming compartments adapted to separate said multiple separate volumes of the liquid phase, said multiple separate volumes communicating through small cross-sectional passages, in order to create hydraulic damping between the separate volumes of the liquid phase.

Thanks to these arrangements, and to the hydraulic damping thus created, excessive movements of liquid fluid are avoided in the reservoir when the device is subjected to acceleration, for example if it is located on a transport vehicle, in this way preventing mixing in the reservoir which could bring about a cold shock effect, namely a sudden decrease of the free surface temperature of the liquid in the reservoir resulting in a pressure drop and reduced efficiency of the loop. Likewise, partitioning the liquid into multiple separate volumes allows to avoid mixing which could occur due to sudden increases in thermal power, especially during startup.

In various embodiments of the invention, one and/or the other of the following arrangements can furthermore optionally be applied:

- the liquid phase does not go over the upper edge of the partitions; which prevents the mixing of the liquid in the event of any acceleration encountered;
- said multiple separate volumes communicate through passages with a small cross-section preferably less than 1/10 of the largest cross-section of the reservoir; whereby the movement of one separate volume to the other is possible but at a low rate of flow;
- the plurality of inner partitions form a regular compartment structure; whereby the partitions support each other mutually;
- the reservoir comprises a macroporous structure and the compartments do not have a microporous structure
- the compartment structure takes the form of a honeycomb structure; such that the compartment structure presents a cost-effective solution since this structure is optimised;
- the device is mainly under the influence of the Earth's gravity and the compartment structure comprises inclined or vertical partitions; such that fluid movement is limited in the event of horizontal acceleration;
- the compartment structure is made of stainless steel; whereby its durability is highly satisfactory;
- the compartment structure is made of plastic compatible with the working fluid, in particular methanol; whereby it is compatible with this commonly used fluid, its service lifetime is satisfactory and its cost is low;
- said multiple separate volumes are formed in a tight mesh structure (metal mesh); whereby an alternative to the partition structure is proposed;
- the compartment structure consists of a phase change material providing thermal inertia; whereby the cold shock effect is further diminished;
- the reservoir includes an input stream deflector; whereby the stream effect produced by the entry of the liquid into the reservoir is restricted to a limited area;
- the reservoir can be located next to the evaporator or the reservoir can be integrated into the evaporator; whereby the mechanical integration of the reservoir can be improved;
- the device includes in addition a non-return device arranged between the inner chamber of the reservoir and the microporous mass of the evaporator, and arranged to prevent the liquid present in the evaporator from moving back into the inner chamber of the reservoir;
- the device is mainly under the influence of gravity, and the non-return device includes a float;
- the heat transfer device preferentially is deprived of a mechanical pump; such that its reliability is increased;
- the device includes in addition an energy-providing element at the reservoir to control the pressurisation of the loop during startup; such that the startup of the loop can be made more reliable.

Other aspects, aims and advantages of the invention will become apparent by reading the following description of several embodiments of the invention, provided as non-limiting examples, with regard to the accompanying drawings in which.

In the different figures, the same references designate identical or similar items.

Figure 1:
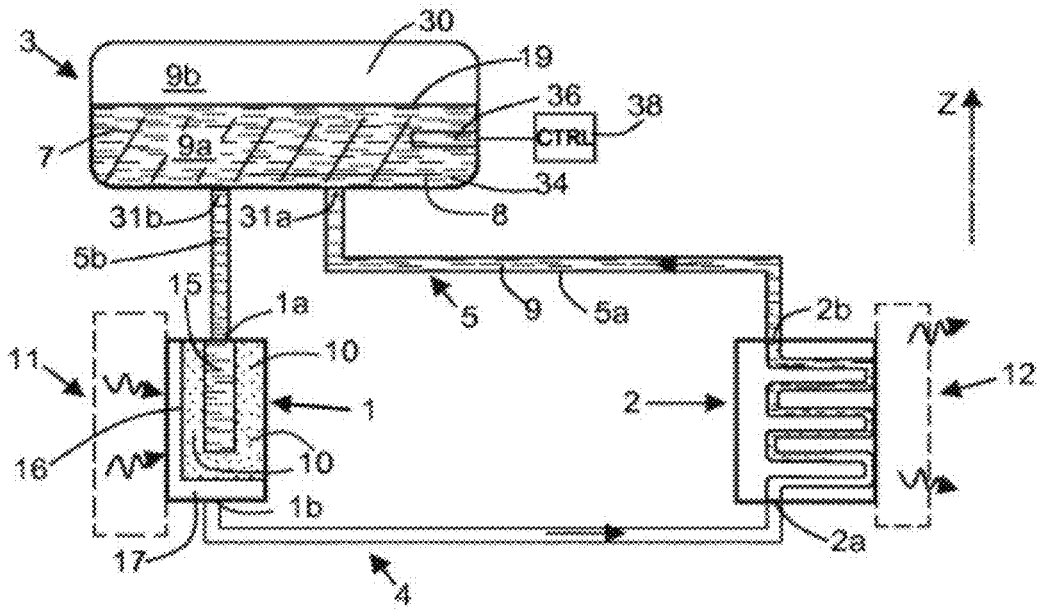
FIG. 1 is a general view of a device according to an embodiment of the invention.

FIG. 1 shows a capillary-driven heat transfer device, with a two-phase fluid loop. The device includes an evaporator 1, with an inlet 1*a* and an outlet 1*b*, and a microporous mass 10 adapted to perform capillary pumping. For this purpose, the microporous mass 10 surrounds a blind central longitudinal recess 15 communicating with inlet 1*a* in order to receive working fluid 9 in a liquid state from a reservoir 3.

The evaporator 1 is thermally coupled with a heat source 11, such as for example an assembly comprising electronic power components or any other heat-generating element, by Joule effect for example, or by any other means.

Under the effect of the supply of calories at the contact 16 with the microporous mass filled with liquid, fluid passes from the liquid state to the vapor state and is evacuated through the transfer chamber 17 and through a first communication circuit 4 which conveys said vapor to a condenser 2 which has an inlet 2*a* and an outlet 2*b*.

In the evaporator 1, the cavities freed by the evacuated vapor are filled with liquid drawn in by the microporous mass 10 from the aforementioned central recess 15; this is the capillary pumping phenomenon as is well known per se.

Inside said condenser 2, heat is released by the fluid in the vapor phase to a cold source 12, which causes cooling of the vapor fluid and its phase change to the liquid phase, that is to say its condensation.

At the condenser 2, the temperature of the working fluid 9 is lowered below its liquid-vapor equilibrium temperature, which is also known as subcooling, such that the fluid cannot revert to the vapor state without a significant heat input.

The vapor pressure pushes the liquid in the direction of outlet 2*b* of the condenser 2 which opens onto a second communication circuit 5, which is also connected to the reservoir 3.

The reservoir exhibits at least one inlet and/or outlet port 31, here in the case of FIG. 1 a separate inlet port 31*a* and outlet port 31*b*, and the reservoir 3 presents an inner chamber 30, filled with the heat transfer fluid 9. The working fluid 9 can be ammonia for example or any other appropriate fluid, but methanol is a preferential choice. The working fluid 9 is a two-phase fluid and is present partly in the liquid phase 9*a* and partly in the vapor phase 9*b*. In an environment where gravity is exerted (vertically according to Z), the gas phase part 9*b* is situated above the liquid phase part 9*a* and a liquid-vapor interface 19 separates the two phases (free surface of the liquid in the reservoir).

It is the temperature of this separation surface 19 which determines the pressure in the loop, this pressure corresponds to the saturation pressure of the fluid at the temperature prevailing at the separation surface 19.

At the base of the reservoir 34, the temperature of the liquid is generally lower than the temperature prevailing at the separation surface 19.

For correct operation of the capillary-driven loop, it is necessary to avoid a rapid change in the temperature prevailing at the separation surface 19, and to avoid in particular mixing of the liquid phase 9*a* which tends to draw cold liquid from the bottom of the reservoir to the top and therefore make the surface temperature decrease, and with it the pressure also.

This phenomenon of a sudden drop in temperature and pressure is commonly known as "cold shock" and must be avoided.

The first and second fluid communication circuits 4,5 are preferably pipes, but they could also be other types of fluid lines or communication channels (rectangular conduits, flexible tubing, etc.).

Figure 2:
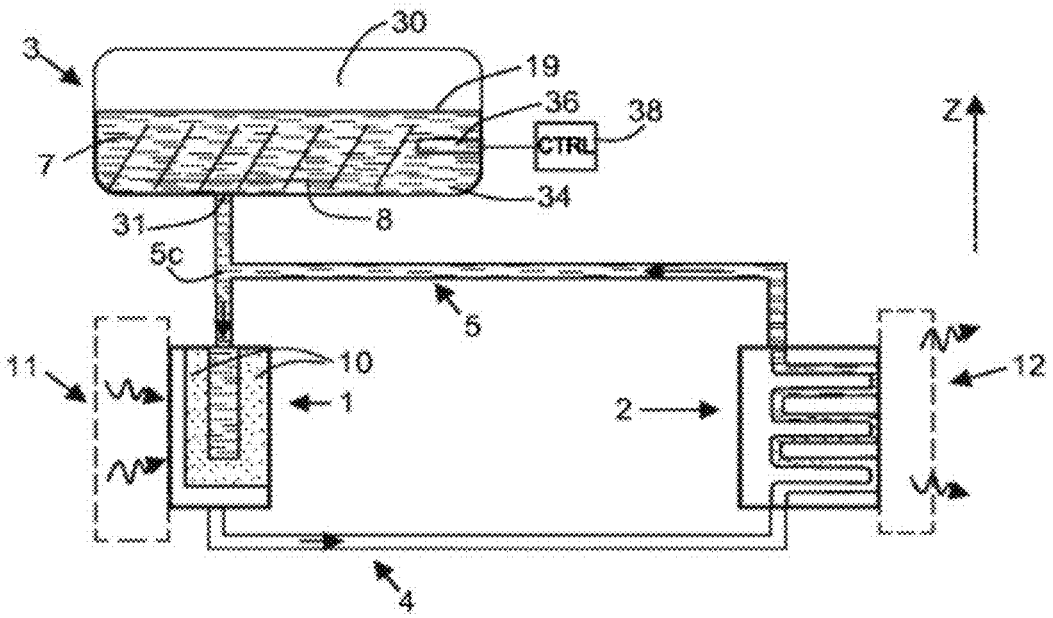
FIG. 2 is a variant of the device of FIG. 1.

Likewise, the second fluid communication circuit 5 can be in the form of two separate and independent conduits 5*a*,5*b* (cf. FIG. 1) or a single conduit with a T coupling 5*c* (cf. FIG. 2).

These conduit configurations remain relevant when several evaporators and/or several condensers are connected in parallel.

In all cases, the second fluid communication circuit 5 connects the condenser outlet 2*b* to the evaporator inlet 1*a*, either indirectly by going through the reservoir (in the case of two independent lines) or directly (in the case of a single line with a T coupling).

With a view to avoiding mixing phenomena in the reservoir which is likely to result in the cold shock phenomenon, multiple separate volumes of liquid are provided inside the reservoir separated from each other but with said separate volumes remaining in fluid communication. In particular, and more precisely, in the reservoir there can be arranged a plurality of inner partitions 7 adapted to separate said multiple separate volumes.

However, according to an alternative, said multiple separate volumes can be formed in a tight mesh structure (not shown in the figures), like for example a steel-wool type structure, or a sponge-type structure or a macroporous structure, or a stack of hollow spheres perforated with small holes.

Moreover, advantageously according to the invention, the reservoir includes an input stream deflector 8 near the inlet port 31*a* or the inlet/outlet port 31 depending on the configuration of the second line.

This input stream deflector prevents a rapid arrival of liquid in the reservoir from creating a bubbling phenomenon or a stream current likely to encourage mixing of the liquid. It can exhibit the form of a U section oriented downwards, or of a bowl or of any other shape creating a sufficient deviation of the trajectory of the input stream.

Figure 3:
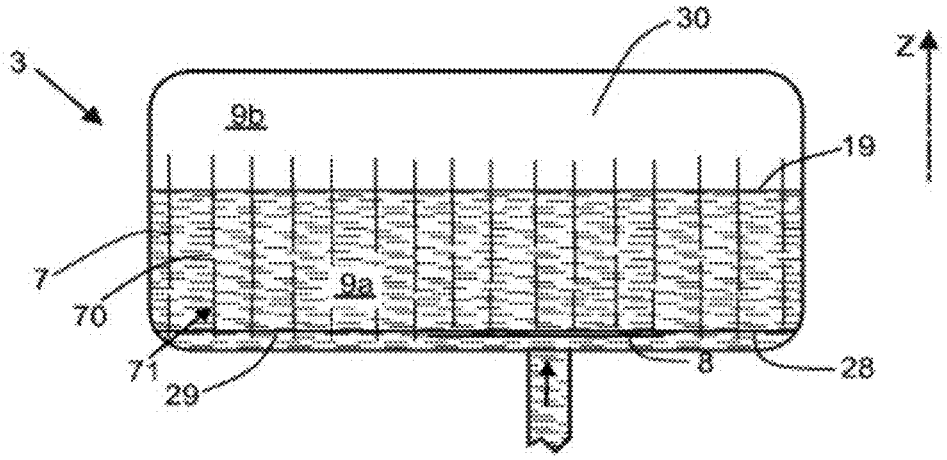
FIG. 3 shows in greater detail the reservoir of the device of FIG. 2, FIGS. 4*a* and 4*b* show compartment structures in the reservoir of the device of FIGS. 1 and 2.

FIG. 3 shows a compartment structure 71, with vertical partitions 7, i.e. oriented in the direction of gravity. It should be noted however that the partitions can just as easily be slightly or substantially inclined, as illustrated for example in FIG. 1. Preferably, the compartment structure is regular, i.e. a certain geometrical pattern is repeated a number of times. it should be noted that the reservoir can have any shape, and in particular be parallelepiped or cylindrical. Moreover, the compartment structure can be made of stainless steel to give it good durability. Further, the compartment structure can be made of plastic compatible with the working fluid and in particular with methanol; whereby it is compatible with this fluid commonly used for land applications, its service lifetime is satisfactory and its cost is low.

According to one aspect of the present invention, said multiple separate volumes communicate through passages with a small cross-section, preferably less than 1/10 of the largest cross-section du reservoir. For example as shown in FIG. 3, the inner partitions 7 present holes 70 with a small passage cross-section, in order to create hydraulic damping between the separate volumes of liquid.

The passages between the separate volumes can also be situated at the base of the compartments, without holes on the upper part of the compartments. In this case, a grid 28 perforated with a plurality of holes with small cross-sections allows the fluid to move between the compartments by going through a transfer chamber 29 located in the base area 34 of the reservoir. This grid 28, also known as a diffuser, can advantageously be used as a support for the compartment structure 71.

The height of the partitions can be between 30% and 90% of the height of the reservoir, and will be chosen in particular so that the upper surface 19 of the liquid does not go over the upper edge of the partitions 7.

Figure 4A:
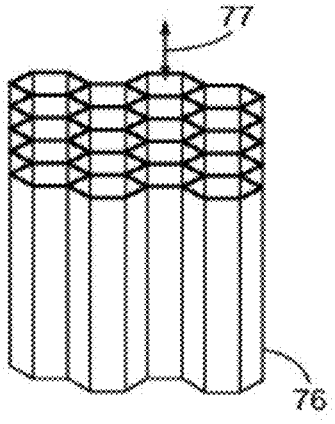
Figure 4B:
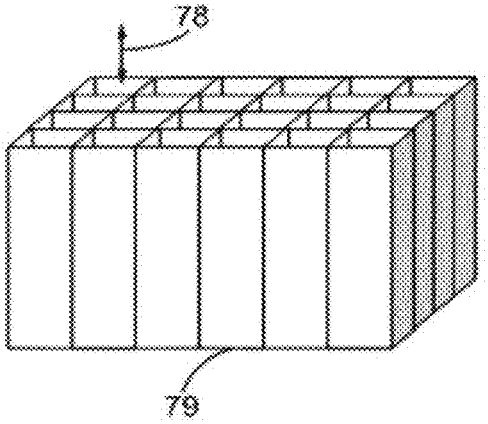

Advantageously, we can choose a honeycomb structure with a hexagonal mesh or a square mesh structure, as shown respectively in FIGS. 4*a* and 4*b*. The hexagon-shaped (or respectively square-shaped 78) compartments 77 communicate through their lower openings 76 (respectively 79).

Moreover, the plurality of partitions can comprise partitions oriented differently with regard to each other. In particular, there may be some partitions parallel to the XZ plane, others parallel to the XY plane and others parallel to the YZ plane: in this way it is possible to limit movement spatially in all directions, which is especially advantageous if the device is used on board an aircraft.

In addition the size of the cells must not be too fine (less than 1 millimeter) otherwise the structure traps the liquid through capillarity and requires overfilling to prevent the loop from drying up during startup in cold conditions or drops in power. The compartments in this way do not have a microporous structure, even though the reservoir can form a macroporous structure.

According to another advantageous aspect of the invention, the compartment structure comprises a phase change material providing thermal inertia to said structure which helps to limit abrupt temperature variations.

Figure 5:
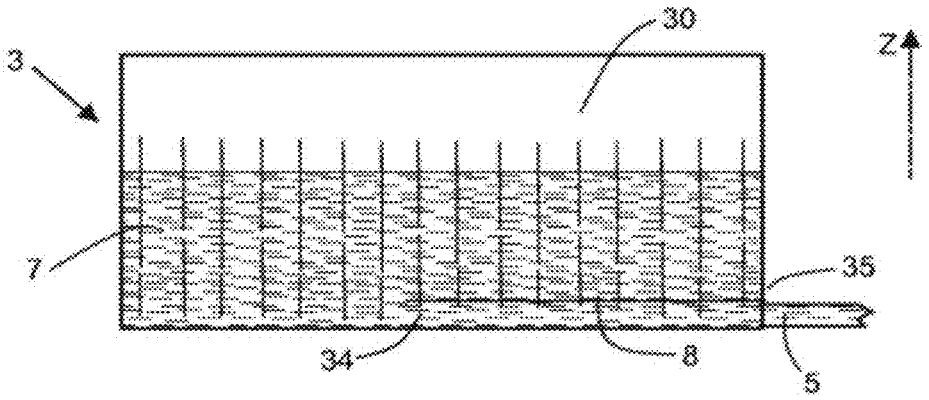
FIG. 5 is analogous to FIG. 3 and shows a variant of the reservoir of the device of FIG. 2.

FIG. 5 is analogous to FIG. 3 and shows a variant of the reservoir of the device with liquid input at the bottom and on the side 35, which may allow to simplify the input stream deflector 8. The input stream deflector 8 can simply be a plate extending horizontally or an extension of tube 5 perforated with a multitude of holes.

Figure 6:
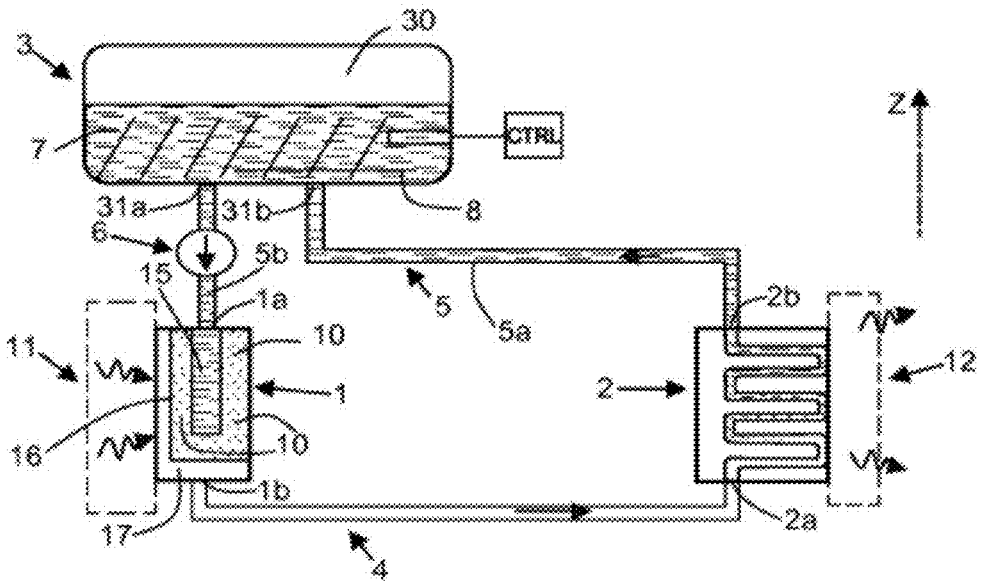
FIG. 6 is a variant of the device of FIG. 1.

Moreover, as shown in FIG. 6 (analogous to FIG. 1), the device may additionally include a non-return device 6, arranged between the inner chamber 30 of the reservoir and the microporous mass 10 of the evaporator, to prevent liquid present in the evaporator from moving back into the inner chamber of the reservoir. This non-return device 6 allows to avoid the movement of liquid from the evaporator in the direction of the reservoir when boiling is triggered during the startup phases of the system.

Preferentially, this non-return device 6 can include a float (not shown in detail) with a density slightly lower than the density of the fluid in the liquid phase.

Furthermore, the device may further include an energy-providing element 36, for example a heating element or a pressuriser element, located at the reservoir to control the pressurisation of the loop during startup. A "Ctrl" control system 38 manages, in the case of a heating element, the supply of calories on this heating element 36, according to temperature information and/or pressure information delivered by sensors (not shown), this being in order to ensure startup of the two-phase loop.

The heating element can be located equally in the liquid phase and/or in the vapor phase. Preferentially this element is situated in the liquid phase and generates vapor towards the upper part of the reservoir. Regulation with the heating element will be facilitated by the presence of a cold source in contact with the latter (ambient air, or other). Moreover, this "Ctrl" control system can also prepare the two-phase loop for an imminent and significant arrival of calories on the evaporator, which allows to anticipate the reaction of the two-phase loop with regard to the need for thermal dissipation. Sizing of the loop can thus be optimised for large amounts of heat to be evacuated.

Advantageously according to the invention, the device does not require the use of a mechanical pump even though the invention does not exclude the presence of an auxiliary mechanical pump.

The invention claimed is:

1. A capillary-driven heat transfer device under an influence of gravity, adapted to extract heat from a heat source and to release this heat to a cold source by means of a two-phase working fluid contained in a closed general circuit, comprising:

an evaporator, having an inlet and an outlet, and a microporous mass adapted to perform capillary pumping of fluid in the liquid phase, a condenser, having an inlet and an outlet, a reservoir having an inner chamber, and at least one inlet and/or outlet port, the inner chamber having a vapor phase portion located on top of a liquid phase portion, a first communication circuit, for fluid mainly in a vapor phase, connecting the outlet of the evaporator to the inlet of the condenser, a second communication circuit, for fluid mainly in a liquid phase, connecting the outlet of the condenser to the reservoir and to the inlet of the evaporator, wherein the reservoir includes plural separate volumes of the liquid phase, said separate volumes remaining in fluid communication, the reservoir including a plurality of inner partitions forming compartments adapted to separate said plural separate volumes of the liquid phase, and small cross-sectional passages, said plural separate volumes communicating through the small cross-sectional passages, in order to create hydraulic damping between the separate volumes of the liquid phase.

2. A device according to claim 1, wherein the liquid phase does not go over an upper edge of the plurality of inner partitions.

3. A device according to claim 1, wherein the plurality of inner partitions form a regular compartment structure.

4. A device according to claim 1, wherein the reservoir includes a macroporous structure and the compartments are deprived of a microporous structure.

5. A device according to claim 4, mainly under an influence of Earth's gravity, wherein the partitions form inclined or vertical separating walls.

6. A device according to claim 4, wherein the compartment structure has a honeycomb structure.

7. A device according to claim 4, wherein the compartment structure includes a phase change material providing thermal inertia.

8. A device according to claim 1, wherein the at least one inlet and/or outlet port includes an inlet port and the reservoir includes an input stream deflector near the inlet port of the reservoir.

9. A device according to claim 1, wherein the reservoir is located next to the evaporator, or the reservoir is integrated into the evaporator.

10. A device according to claim 1, including a non-return device arranged between the inner chamber of the reservoir and the microporous mass of the evaporator, and arranged to prevent the liquid present in the evaporator from moving into the inner chamber of the reservoir.

11. A device according to claim 10, mainly under the influence of the Earth's gravity, wherein the non-return device includes a float.

12. A heat transfer device according to claim 1, wherein the heat transfer device is deprived of a mechanical pump.

13. A device according to claim 1, wherein the evaporator, condenser, reservoir, first communication circuit, and second communication circuit are part of a loop, the device additionally including an energy-providing element at the reservoir to control pressurisation of the loop during startup.

14. A device according to claim 1, wherein the small cross-sectional passages have a cross-section that is less than 1/10 of the largest cross-section of the reservoir.

* * * * *